US007330113B1

(12) United States Patent
DeCosey

(10) Patent No.: US 7,330,113 B1
(45) Date of Patent: Feb. 12, 2008

(54) MULTIFUNCTIONAL LOCATING AND ACTUATING SYSTEM

(76) Inventor: Randall C. DeCosey, 1234 Triangle Dr., Lake Wales, FL (US) 33853

( * ) Notice: Subject to any disclaimer, the term of this patent is extended or adjusted under 35 U.S.C. 154(b) by 216 days.

(21) Appl. No.: 11/318,136

(22) Filed: Dec. 27, 2005

(51) Int. Cl.
*G08B 1/08* (2006.01)
*G08B 7/00* (2006.01)

(52) U.S. Cl. ..... 340/539.32; 340/426.13; 340/426.36; 340/426.35; 340/825.69

(58) Field of Classification Search ..... 340/539.32, 340/426.13, 426.36, 426.35
See application file for complete search history.

(56) References Cited

U.S. PATENT DOCUMENTS 5,598,143 A 1/1997 Wentz
5,677,673 A 10/1997 Kipnis
5,680,105 A 10/1997 Hedrick
5,939,981 A 8/1999 Renney
6,133,832 A 10/2000 Winder et al.
D476,588 S 7/2003 Lee
2003/0210132 A1* 11/2003 Tang et al. ..... 340/5.64

* cited by examiner

*Primary Examiner*—Donnie L. Crosland

(57) ABSTRACT

A system includes a controller including a housing and a mechanism for generating RF output signals. The output signal generating mechanism includes controls mated to the housing. A mechanism is included for uniquely coding the output signals so that each output signal is detected by only a corresponding object. A mechanism is included for displaying a date and time. A radio mechanism is included for tuning into a radio station and playing an audible signal. A base station is mated with a power supply source and includes a transformer and an electrical contact coupled thereto. The controller is engageable with the electrical contact for being recharged. The base station includes a bottom layer formed from rubber material for maintaining same stable during recharging conditions. The system includes objects including transceivers housed therein and a mechanism for decoding the output signals such that the objects can generate and transmit response signals.

15 Claims, 8 Drawing Sheets

MULTIFUNCTIONAL LOCATING AND ACTUATING SYSTEM

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to locating and actuating systems and, more particularly, to a multifunctional locating and actuating system for locating objects and actuating door locks.

2. Prior Art

Consumer electronic devices such as TVs, VCRs, and satellite receivers have optional remote controls which are separate from the major device and other articles such as keys, glasses, articles of clothing and generally items which are hand carried by a person are prone to misplacement. Often, while not lost, the items are concealed by furniture or other objects, or simply placed in an unusual location where the owner has difficulty in locating them.

It can be bothersome and time consuming when at home to search for items such as keys, wallets, remote controls etc. that have been mislaid. In addition, at business locations such as offices, warehouses and the like, many valuable employee hours are lost each year searching for mislaid files, equipment, merchandise and the like. It would be a benefit, therefore, to have a system for locating these articles that included a number of receiver units that would each be attached to an article and a transmitter that activated any particular receiver causing the activated receiver to generate an audible and/or a visual output to aid in locating the article to which the receiver unit was attached.

Numerous innovations for an item locator with an attachable receiver/transmitter have been provided in the prior art. By way of example, the prior art discloses a locator mechanism for assisting and locating an object that includes a hand held searcher including a short range signal transmitter. Another example discloses a mechanism for locating a remote control device, wherein the device is hard wired into the circuitry of the appliance. Although the above noted devices are sufficient in their intended purposes they still have many obvious shortcomings.

One disadvantage of such devices is the lack of providing a light source that can aid a user in searching for lost items, as well as general use of the light source as a flashlight. The prior art device all consist of units that are separate from items such as car door and garage door openers, thus a user is required to carry multiple units in order to open those doors as well as the locator unit. This can become burdensome and discourage use of the device. The prior art devices are not user friendly and are relatively expensive to produce, which unfortunately causes those production costs to be incurred onto the consumer.

Accordingly, a need remains for a multifunctional locating and actuating system in order to overcome the above-noted shortcomings. The present invention satisfies such a need by providing a multifunctional locating and actuating system that is convenient and easy to use, provides considerable time savings, and is versatile and compact in design. Such a system advantageously ends the frustration associated with misplacing a set of keys or other items, such as remote controls. The system also serves as a convenient remote car and garage door opener, thus eliminating the need to carry individual units for those purposes. Such a system also includes an easily operated flashlight that facilitates a user in finding a house or car door key hole in the dark.

BRIEF SUMMARY OF THE INVENTION

In view of the foregoing background, it is therefore an object of the present invention to provide a multifunctional locating and actuating system. These and other objects, features, and advantages of the invention are provided by a wireless system for locating objects and actuating door locks.

The system includes a portable central controller including a housing suitably sized and shaped for conveniently fitting in a user's hand. Such a central controller includes a mechanism for generating a plurality of RF output signals responsive to a user input. The output signal generating mechanism includes a plurality of controls operably mated to a top face of the housing. The central controller also includes a mechanism for uniquely coding the output signals such that each of the output signals can effectively be detected by only a corresponding one of the objects respectively.

A mechanism is included for displaying a date and time on a top face of the housing. The central controller further includes a radio mechanism for tuning into a radio station and playing an audible signal from a remote source. Such date and time displaying mechanism and the radio mechanism are simultaneously and independently operable while the output signal generating mechanism is active. The central controller may be provided with a cavity formed along a bottom face thereof. Such a central controller further includes an access door removably conjoinable with the bottom face such that the user can conveniently securely store a plurality of backup objects therein.

The central controller may further include a processor and a memory including software instructions for effectively causing the central controller to perform a plurality of steps. Such steps include determining which one of the controls have been activated by the user, communicating with the date and time displaying mechanism to determine when the one control was activated, and sending the output signal to the coding mechanism when the date and time falls within a predetermined interval such that the objects can be located and activated only during the predetermined interval.

A base station is electrically mated with an external power supply source. Such a base station includes a transformer and at least one electrical contact directly coupled thereto. The central controller is removably engageable directly on top of the electrical contact for conveniently and effectively being recharged after periodic use. The base station further includes a bottom layer formed from rubber material for advantageously and effectively maintaining the base station at a substantially stable position during recharging conditions.

The present system further includes a plurality of objects including a plurality of transceivers housed therein respectively. The plurality of objects further include a mechanism for decoding the output signals such that corresponding one of the objects can effectively generate and transmit a response signal unique to a selected one of the output signals. A user can conveniently remotely locate the objects by depressing a selected one of the controls associated with a selected one of the objects.

Each of the plurality of objects preferably further includes a processor, and at least one LED and a speaker electrically mated to the processor respectively. Such a processor generates and transmits the response signal to the LED and the speaker such that a visual signal and an audible signal are simultaneously emitting from the objects during operating conditions respectively. The speaker preferably includes a piezoelectric transducer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
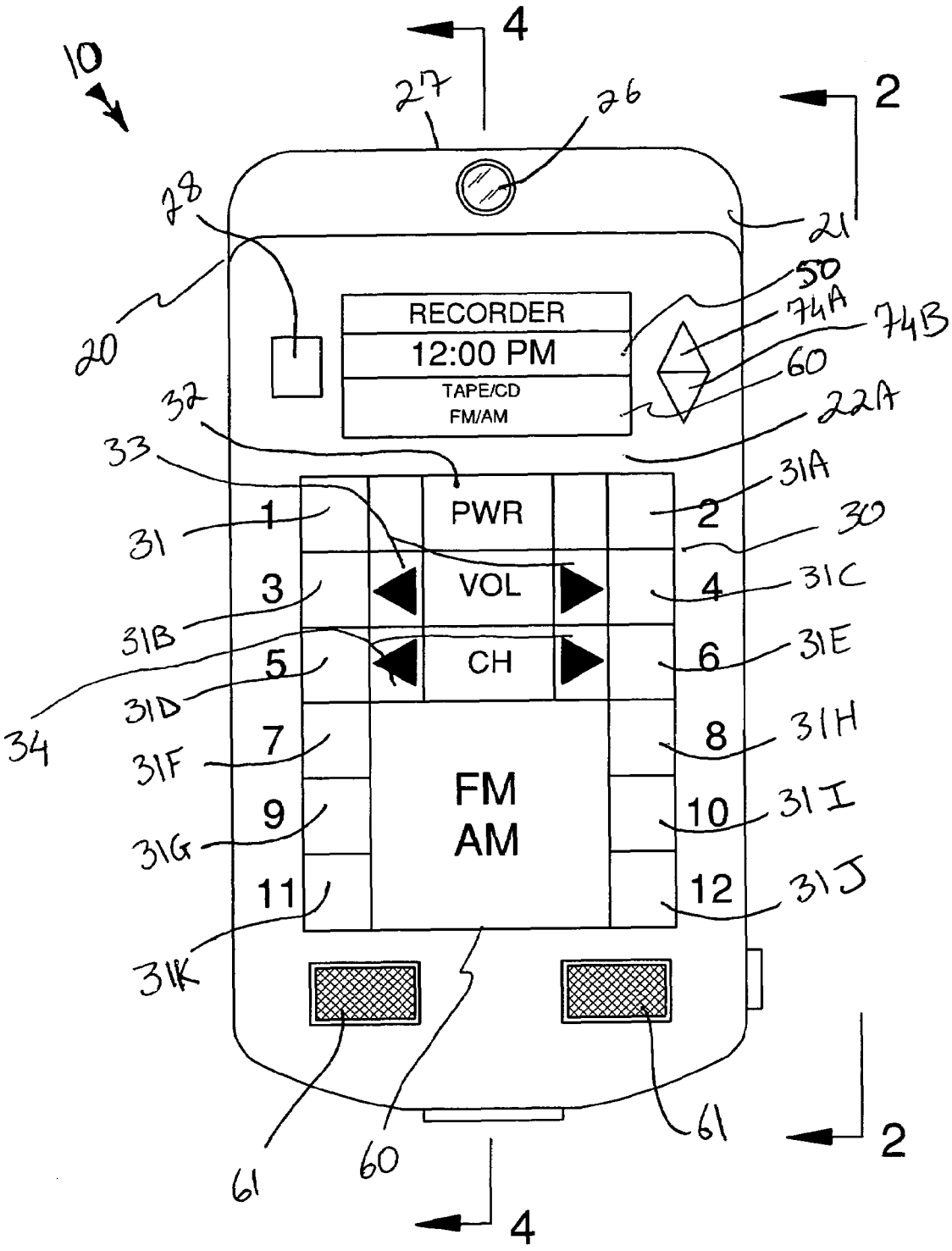
FIG. 1 is a top plan view showing a multifunctional locating and actuating system, in accordance with the present invention.
Figure 2:
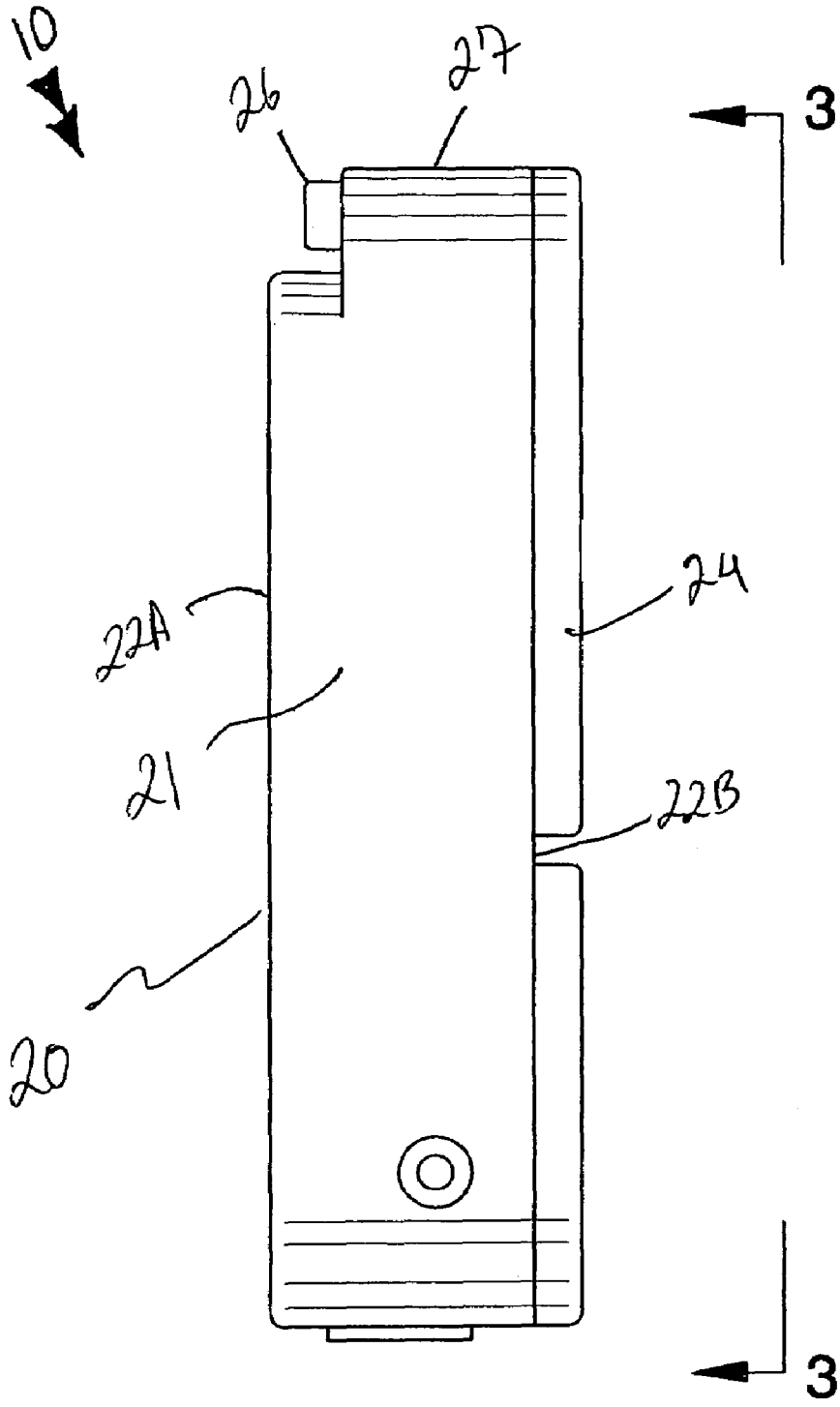
FIG. 2 is a side-elevational view of the central controller shown in FIG. 1, taken along line 2-2.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refer to alternate embodiments of such elements.

The system of this invention is referred to generally in FIGS. 1-9 by the reference numeral 10 and is intended to provide a multifunctional locating and actuating system. It should be understood that the system 10 may be used to locate and actuate many different types of items and devices and should not be limited in use to only locating and activating keys and garage doors, respectively.

Referring initially to FIG. 1, the system 10 includes a portable central controller 20 including a housing 21 suitably sized and shaped for conveniently fitting in a user's hand, which is essential for allowing the controller 20 to be easily transported and operated. Such a central controller 20 includes a mechanism 30 for generating a plurality of RF output signals responsive to a user input. The output signal generating mechanism 30 includes a plurality of controls 31 operably mated to a top face 22A of the housing 21.

Such a plurality of controls 31 includes a KEY BEEPER control 31A, a TAPE/CD control 31B, a DVD control 31C, an FM/AM control 31D, a TV control 31E, a DOOR LOCK control 31F, a DOOR UNLOCK control 31G, a GAS TANK ACCESS DOOR control 31H, an LOCK CAR TRUNK control 31I, an UNLOCK CAR TRUNK control 31J, and a SATELLITE STEREO control 31K. Of course, for ease in distinguishing among the plurality of controls 31, each control may conveniently be produced in a unique color or with numbered indicia thereon, as is obvious to a person of ordinary skill in the art.

The signal generating mechanism also includes a power button 32, volume control buttons 33 and channel adjusting buttons 34. Such power 32, volume 33 and channel adjusting 34 buttons selectively a user to control various devices, such as televisions, radios and DVDs, after their associated control 31 is activated. This feature thus greatly increases the versatility of the system 10, making it rather appealing to consumers that wish to reduce the clutter associated with having multiple remote controls.

Figure 9:
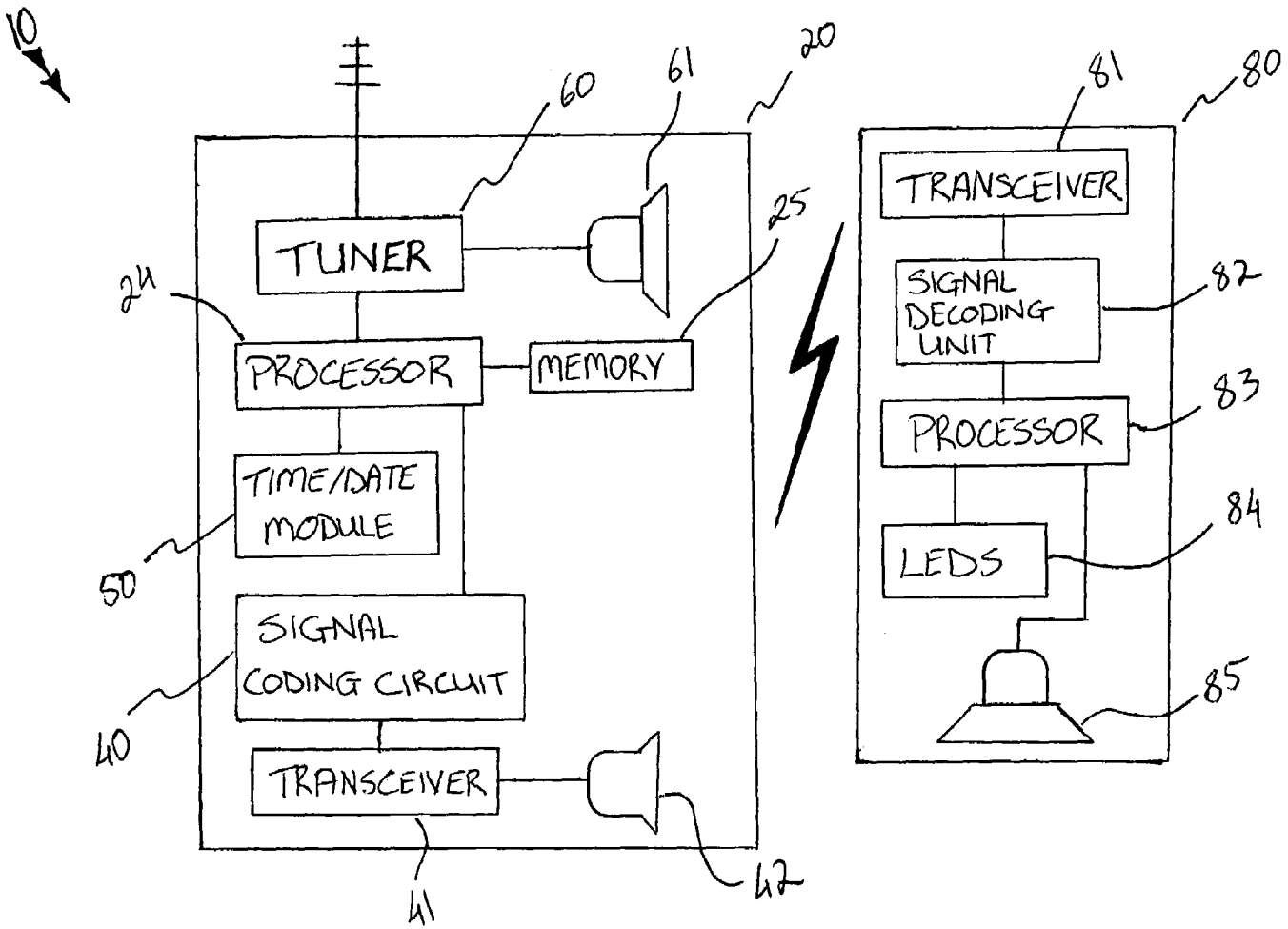
FIG. 9 is a schematic block diagram of the system shown in FIGS. 1 and 5.

Referring to FIGS. 1 and 9, the central controller 20 also includes a mechanism 40 for uniquely coding the output signals, which is crucial such that each of the output signals can effectively be detected by only a corresponding one of the objects 80 (described herein below) respectively. The signal coding mechanism includes a transceiver 41 that is crucial for effectively transmitting the output signal to the objects 80. Such a transceiver 41 includes an amplifier 42 electrically mated thereto that is advantageous for increasing the output signal, allowing the output signal to reach a selected object 80 remotely located from the central controller 20.

A mechanism 50 is included for displaying a date and time on a top face 22A of the housing 20. The central controller 20 further includes a radio mechanism 60 for tuning into a radio station and playing an audible signal from a remote source. Such date and time displaying mechanism 50 and the radio mechanism 60 are simultaneously and independently operable while the output signal generating mechanism 30 is active. The radio mechanism 60 further includes a plurality of speakers 61 positioned on the top face 22A of the housing.

The controller 20 also includes a light emitting source 26 positioned along a top edge 27 of the housing 20 that is important for providing a user with a convenient light source at night time. A light source activating/deactivating button 28 is located on the top face 22A of the housing 20 for allowing a user to selectively toggle the light emitting source 26 between ON and OFF modes.

Figure 3:
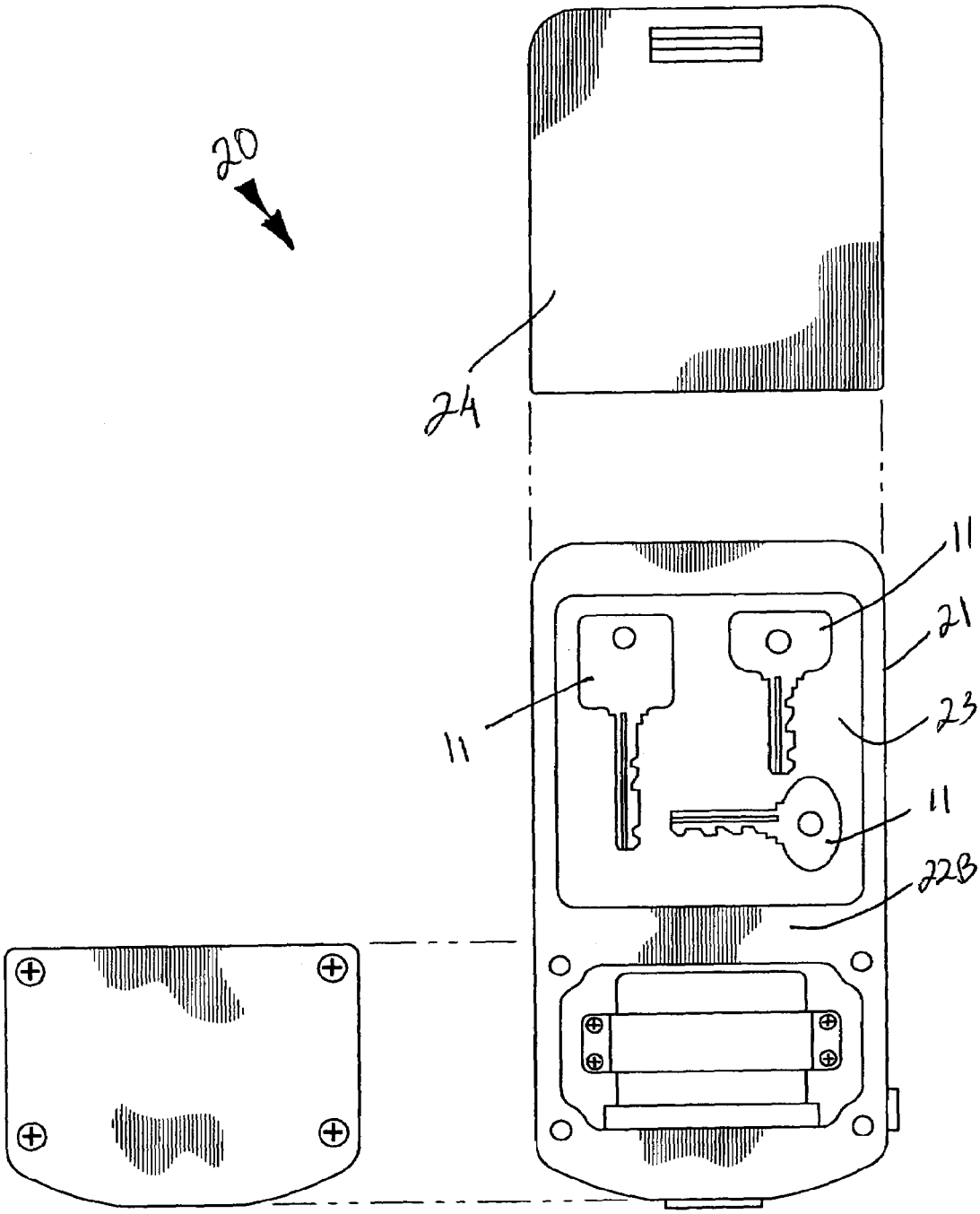
FIG. 3 is a rear-elevational view of the central controller show in FIG. 2, taken along line 3-3 and showing the access door removed therefrom.
Figure 4:
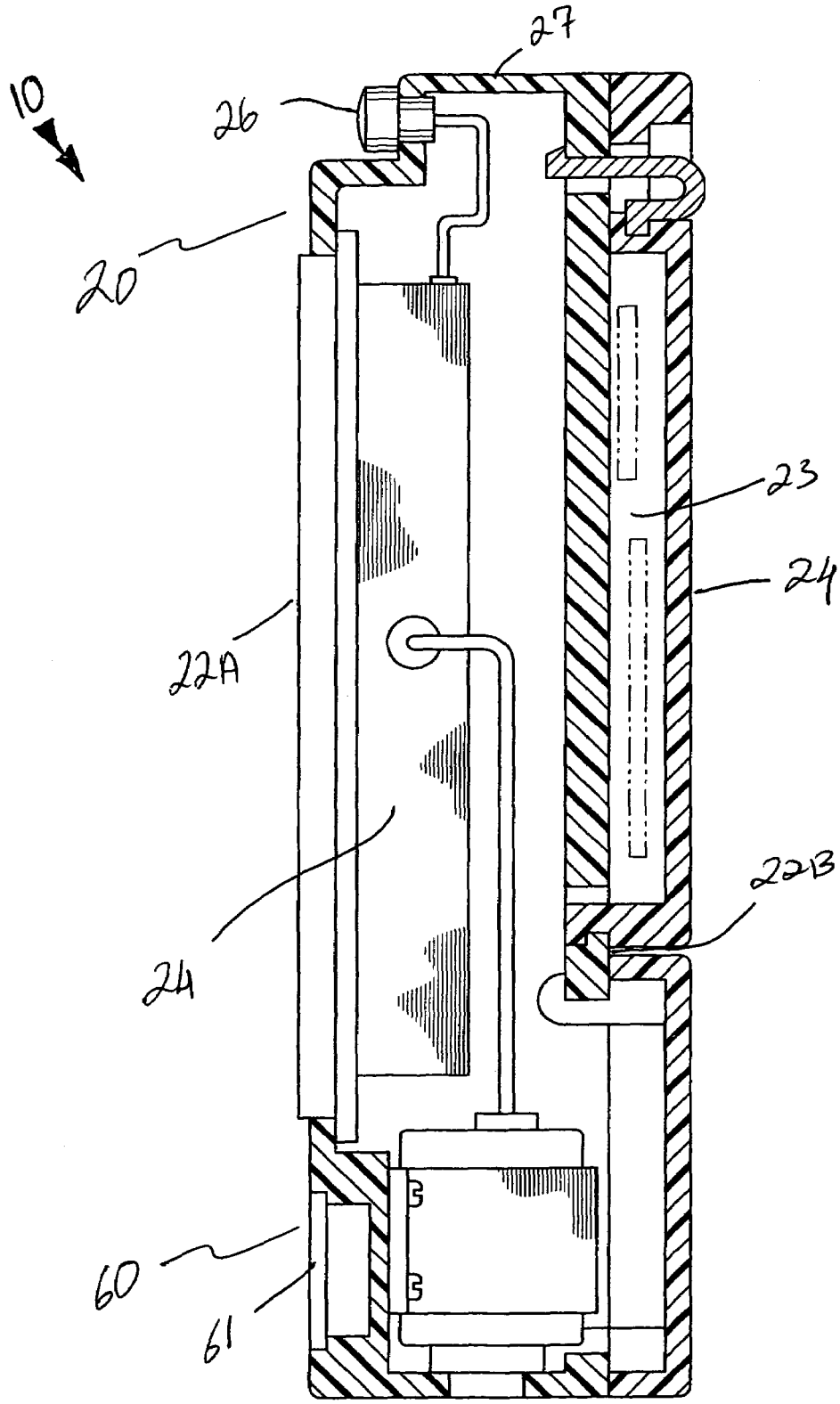
FIG. 4 is a cross-sectional view of the central controller shown in FIG. 1, taken along line 4-4.

Referring to FIGS. 3 and 4, the central controller 20 is provided with a cavity 23 formed along a bottom face 22B thereof. Such a central controller 20 further includes an access door 24 removably conjoinable with the bottom face 22B, which is vital and advantageous such that the user can conveniently securely store a plurality of backup objects 11 therein. Of course, the cavity 23 may be used to store a variety of back up objects 11 therein, like keys, credit cards, business cards etc., as is obvious to a person of ordinary skill in the art.

Referring to FIGS. 4 and 9, the central controller 20 includes a processor 24 and a memory 25 including software instructions for effectively causing the central controller 20 to perform a plurality of steps. Such steps include determining which one of the controls 31 have been activated by the user, communicating with the date and time displaying mechanism 50 to determine when the one control 31 was activated, and sending the output signal to the coding mechanism 40 when the date and time falls within a predetermined interval such that the objects 80 can be located and activated only during the predetermined interval.

Figure 8:
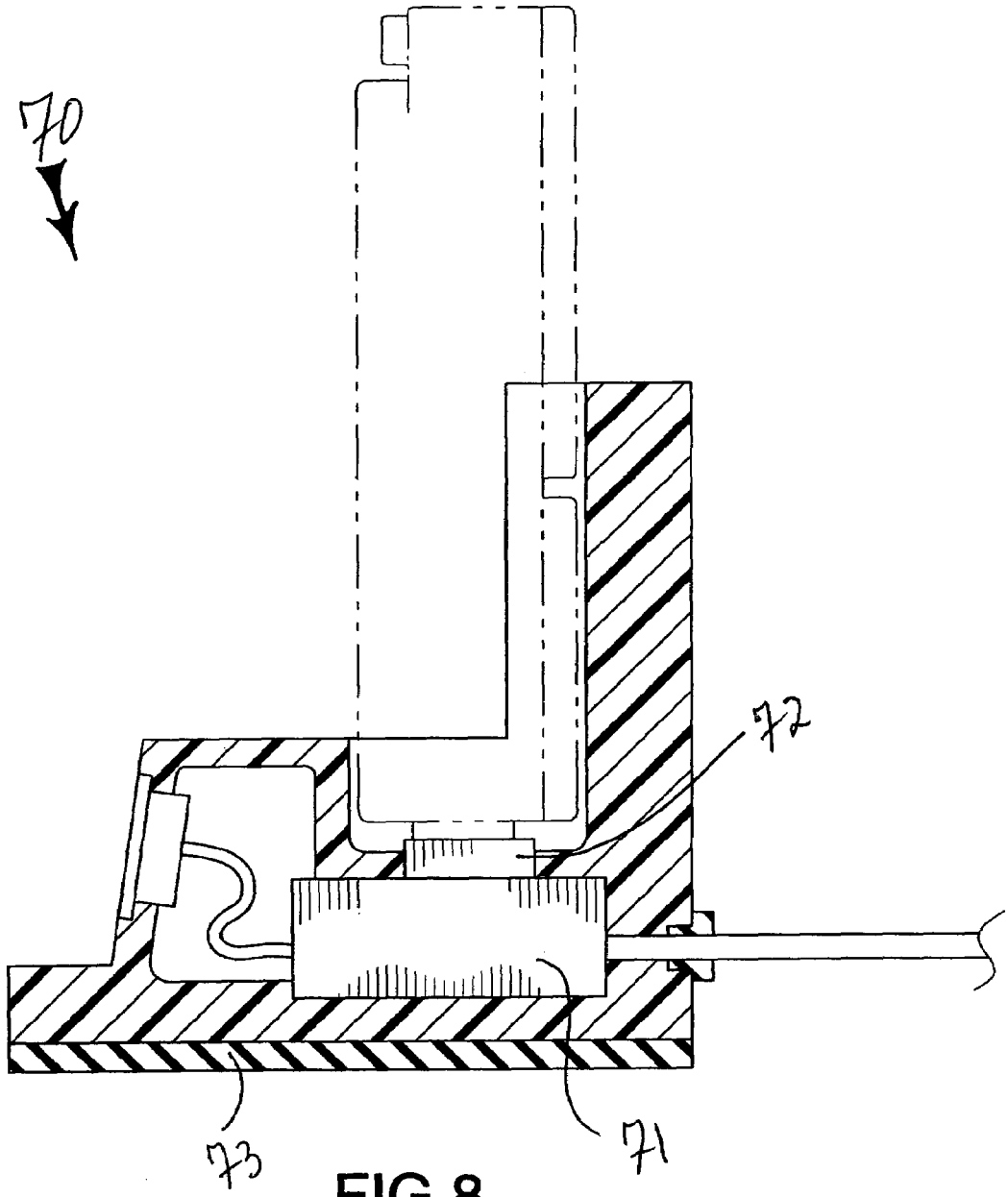
FIG. 8 is a cross-sectional view of the base station in accordance with the present invention.

Referring to FIG. 8, a base station 70 is electrically mated with an external power supply source. Such a base station 70 includes a transformer 71 and at least one electrical contact 72 directly coupled, with no intervening elements, thereto. The central controller 20 is removably engageable directly, with no intervening elements, on top of the electrical contact 72, which is vital for conveniently and effectively being recharged after periodic use. This feature advantageously eliminates the need for repeatedly purchasing new batteries, which can become quite expensive over time.

The base station 70 further includes a bottom layer 73 formed from rubber material for advantageously and effectively maintaining the base station 70 at a substantially stable position during recharging conditions. Of course, the bottom layer 73 may be formed from other suitable material for maintaining the stability of the base station 70, as is obvious to a person of ordinary skill in the art. The housing 20 includes a plurality of indicator lights 74, wherein a first light 74A indicates a fully charged state of the system 10 and a second light 74B conveniently indicates a low charge state of the system 10 for notifying the user to recharge the system 10.

Figure 6:
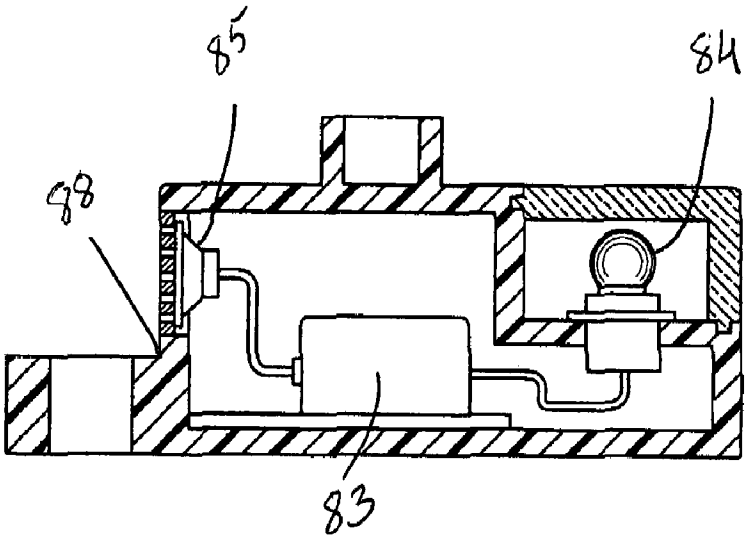
FIG. 6 is a cross-sectional view of the object shown in FIG. 5, taken along line 6-6.
Figure 5:
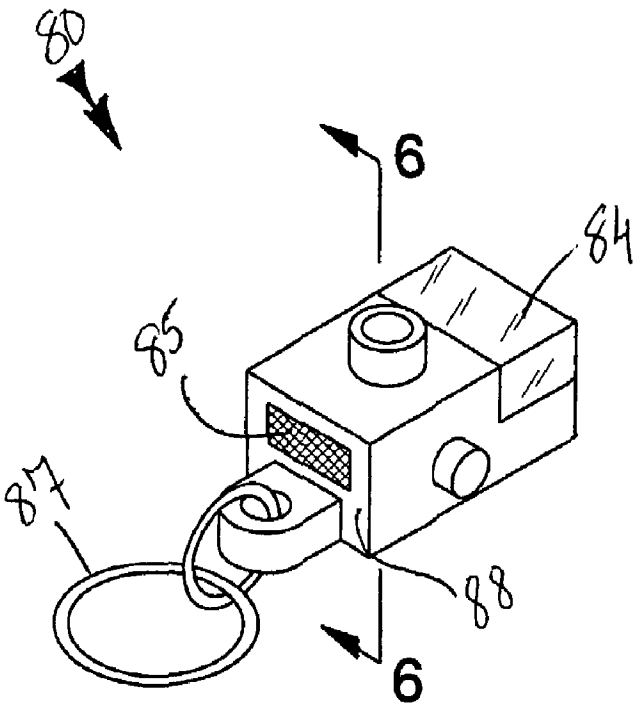
FIG. 5 is a perspective view of one of the plurality of objects, in accordance with the present invention.

Referring to FIGS. 5, 6 and 9, the present system 10 further includes a plurality of objects 80 including a plurality of transceivers 81 housed therein respectively. The plurality of objects 80 further include a mechanism 82 for decoding the output signals such that corresponding one of the objects 80 can effectively generate and transmit a response signal unique to a selected one of the output signals. A user can conveniently remotely locate the objects 80 by depressing a selected one of the controls 31 associated with a selected one of the objects 80.

Still Referring to FIGS. 5, 6 and 9, each of the plurality of objects 80 further includes a processor 83, and at least one LED 84 and a speaker 85 electrically mated to the processor 83 respectively. Such a processor 83 is crucial for generating and transmitting the response signal to the LED 84 and the speaker 85 such that a visual signal and an audible signal are simultaneously emitting from the objects 80 during operating conditions respectively. The speaker 85 includes a piezoelectric transducer. The object 80 further includes an annular ring 87 attached to one end portion 88 thereof for conveniently allowing a user to attach the object 80 to their key ring.

Figure 7:
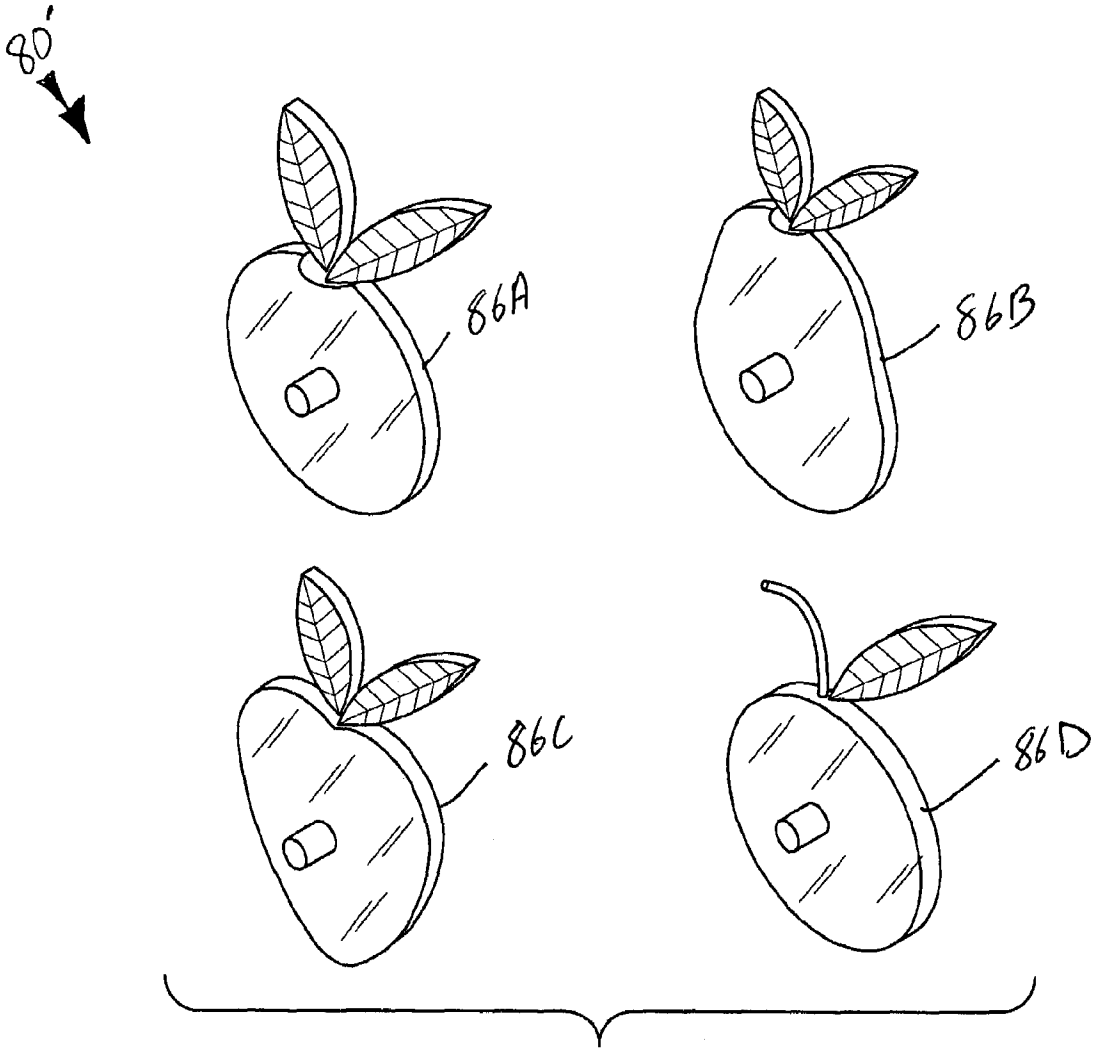
FIG. 7 is a perspective view showing an alternate embodiment of the object shown in FIG. 5.

Referring to FIG. 7, in an alternate embodiment 80', the objects 80' are shaped to represent various types of fruit. Such objects 80' include an orange type 86A, a pear type 86B, a strawberry type 86C and an apple type 86D fruit shaped object 80'. Of course, the objects 80' may be shaped to represent a variety of different goods and items, as is obvious to a person of ordinary skill in the art.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A wireless system for locating objects and actuating door locks, said system comprising:

a portable central controller including a housing suitably sized and shaped for fitting in a user's hand, said central controller comprising means for generating a plurality of RF output signals responsive to a user input, said output signal generating means comprising a plurality of controls operably mated to a top face of said housing, means for uniquely coding said output signals such that each said output signals can be detected by only a corresponding one of the objects respectively, means for displaying a date and time on a top face of said housing, and radio means for tuning into a radio station and playing an audible signal from a remote source; and a plurality of objects comprising a plurality of transceivers housed therein respectively, and means for decoding said output signals such that said corresponding one of said objects can generate and transmit a response signal unique to a selected one of said output signals;

wherein a user can remotely locate the objects by depressing a selected one of said controls associated with a selected one of the objects;

wherein said date and time displaying means and said radio means are simultaneously and independently operable while said output signal generating means is active.

2. The system of claim 1, wherein each said plurality of objects further comprise:

a processor;

at least one LED and a speaker electrically mated to said processor respectively;

wherein said processor generates and transmits said response signal to said LED and said speaker such that a visual signal and an audible signal are simultaneously emitting from said objects during operating conditions respectively.

3. The system of claim 1, wherein said central controller further comprises:

a processor;

a memory including software instructions for causing said central controller to perform the steps of:

determining which one of said controls have been activated by the user, communicating with said date and time displaying means to determine when said one control was activated, and sending said output signal to said coding means when the date and time falls within a predetermined interval such that said objects can be located and activated only during the predetermined interval.

4. The system of claim 1, wherein said central controller is provided with a cavity formed along a bottom face thereof, said central controller further including an access door removably conjoinable with said bottom face such that the user can securely store a plurality of backup objects therein.

5. The system of claim 2, wherein said speaker comprises: a piezoelectric transducer.

6. A wireless system for locating objects and actuating door locks, said system comprising:

a portable central controller including a housing suitably sized and shaped for fitting in a user's hand, said central controller comprising means for generating a plurality of RF output signals responsive to a user input, said output signal generating means comprising a plurality of controls operably mated to a top face of said housing, means for uniquely coding said output signals such that each said output signals can be detected by only a corresponding one of the objects respectively, means for displaying a date and time on a top face of said housing, and radio means for tuning into a radio station and playing an audible signal from a remote source;

a base station electrically mated with an external power supply source, said base station including a transformer and at least one electrical contact directly coupled thereto, said central controller being removably engageable directly on top of said electrical contact for being recharged after periodic use; and a plurality of objects comprising a plurality of transceivers housed therein respectively, and means for decoding said output signals such that said corresponding one of said objects can generate and transmit a response signal unique to a selected one of said output signals;

wherein a user can remotely locate the objects by depressing a selected one of said controls associated with a selected one of the objects;

wherein said date and time displaying means and said radio means are simultaneously and independently operable while said output signal generating means is active.

7. The system of claim 6, wherein each said plurality of objects further comprise:

a processor;

at least one LED and a speaker electrically mated to said processor respectively;

wherein said processor generates and transmits said response signal to said LED and said speaker such that a visual signal and an audible signal are simultaneously emitting from said objects during operating conditions respectively.

8. The system of claim 6, wherein said central controller further comprises:

a processor;

a memory including software instructions for causing said central controller to perform the steps of:

determining which one of said controls have been activated by the user, communicating with said date and time displaying means to determine when said one control was activated, and sending said output signal to said coding means when the date and time falls within a predetermined interval such that said objects can be located and activated only during the predetermined interval.

9. The system of claim 6, wherein said central controller is provided with a cavity formed along a bottom face thereof, said central controller further including an access door removably conjoinable with said bottom face such that the user can securely store a plurality of backup objects therein.

10. The system of claim 7, wherein said speaker comprises: a piezoelectric transducer.

11. A wireless system for locating objects and actuating door locks, said system comprising:

a portable central controller including a housing suitably sized and shaped for fitting in a user's hand, said central controller comprising means for generating a plurality of RF output signals responsive to a user input, said output signal generating means comprising a plurality of controls operably mated to a top face of said housing, means for uniquely coding said output signals such that each said output signals can be detected by only a corresponding one of the objects respectively, means for displaying a date and time on a top face of said housing, and radio means for tuning into a radio station and playing an audible signal from a remote source;

a base station electrically mated with an external power supply source, said base station including a transformer and at least one electrical contact directly coupled thereto, said central controller being removably engageable directly on top of said electrical contact for being recharged after periodic use;

wherein said base station further includes a bottom layer formed from rubber material for maintaining said base station at a substantially stable position during recharging conditions; and a plurality of objects comprising a plurality of transceivers housed therein respectively, and means for decoding said output signals such that said corresponding one of said objects can generate and transmit a response signal unique to a selected one of said output signals;

wherein a user can remotely locate the objects by depressing a selected one of said controls associated with a selected one of the objects;

wherein said date and time displaying means and said radio means are simultaneously and independently operable while said output signal generating means is active.

12. The system of claim 11, wherein each said plurality of objects further comprise:

a processor;

at least one LED and a speaker electrically mated to said processor respectively;

wherein said processor generates and transmits said response signal to said LED and said speaker such that a visual signal and an audible signal are simultaneously emitting from said objects during operating conditions respectively.

13. The system of claim 11, wherein said central controller further comprises:

a processor;

a memory including software instructions for causing said central controller to perform the steps of:

determining which one of said controls have been activated by the user, communicating with said date and time displaying means to determine when said one control was activated, and sending said output signal to said coding means when the date and time falls within a predetermined interval such that said objects can be located and activated only during the predetermined interval.

14. The system of claim 11, wherein said central controller is provided with a cavity formed along a bottom face thereof, said central controller further including an access door removably conjoinable with said bottom face such that the user can securely store a plurality of backup objects therein.

15. The system of claim 12, wherein said speaker comprises: a piezoelectric transducer.

* * * * *